United States Patent [19]

Bereiter et al.

[11] 4,202,280

[45] May 13, 1980

[54] FURNACE FLUE APPARATUS FOR IMPROVED FLY ASH SEPARATION

[76] Inventors: Rolf Bereiter, Hinteregg; Alexander Jachimowski, Andelfingen, both of Switzerland

[21] Appl. No.: 882,403

[22] Filed: Mar. 1, 1978

[30] Foreign Application Priority Data

Mar. 7, 1977 [CH] Switzerland ..... 2821/77

[51] Int. Cl.[2] ..... F23G 5/00

[52] U.S. Cl. ..... 110/216; 55/462; 110/165 A; 110/119

[58] Field of Search ..... 110/119, 165 A, 322, 110/323, 216; 55/434, 462

[56] References Cited

U.S. PATENT DOCUMENTS

| | | | |
|---|---|---|---|
| 2,677,437 | 5/1954 | Wagner | 110/165 |
| 2,949,099 | 8/1960 | Miller | 110/165 |
| 2,994,287 | 8/1961 | Freiday | 110/322 |
| 3,110,273 | 11/1963 | Beusman et al. | 110/323 |

*Primary Examiner*—Edward G. Favors

[57] ABSTRACT

The disclosed apparatus is disposed in the "U"-section deflector at the bottom end of flues connected to each other in a multiple-flue, vertical flue furnace. A deflecting plate and two associated projections, one on the plate and the other on the wall, influence the flow of gases in such a manner that first the radius of curvature of the gas making the turn is decreased, and second the distribution of flow at the input cross-section of the flow-receiving flue is more uniform. The first effect improves the effectiveness of fly ash removal from the turning gas stream. The second effect prevents localized sooting and uneven heating of a heat exchanger which may be installed in the end of the receiving flue.

19 Claims, 9 Drawing Figures

FIG. 1 *PRIOR ART*
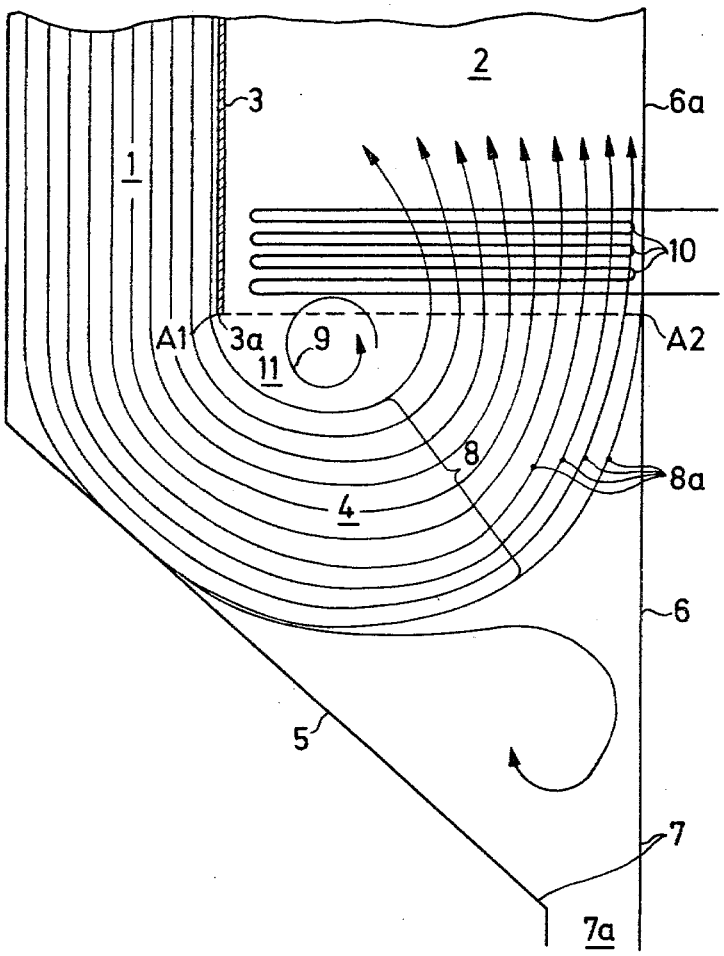
FIG. 2 *PRIOR ART*
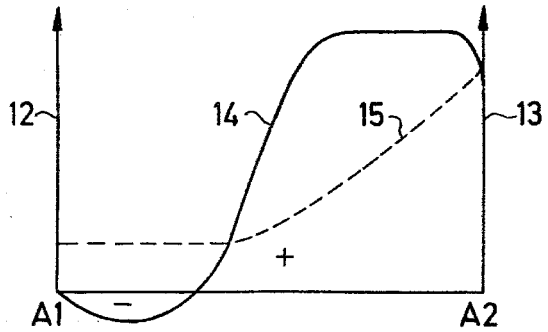

FURNACE FLUE APPARATUS FOR IMPROVED FLY ASH SEPARATION

BACKGROUND OF THE INVENTION

The invention relates to an apparatus for improving the fly ash separation in a combustion furnace, particularly in an incinerator with a multiple-flue boiler in which two vertical flues are interconnected by a lower flow-reversing deflector section.

In the case of combustion furnaces with an incorporated steam generator it is not generally possible to position the boiler as a linear vertical unit, i.e., a so-called "single-flue boiler," above the furnace combustion chamber. Therefore, the flue gas path in the furnace is divided up into several vertical flue sections which are interconnected at the ends by a flow-reversing deflector section of, for example, two 90° elbow deflector or one 180° "U" deflector. At the lower ends of the vertical flues, there are provided 180° deflectors which are at the same time constructed as ash removal hoppers. Due to centrifugal forces, the flue gas flow is separated on flowing through these lower deflections, so that the flue gases flow with locally very high speeds against only one side of the upwardly directed vertical flue. In addition, the centrifugal acceleration of the flue gases leads to the fly ash being carried outwards in the flue gas flow. Relatively large particles of ash, whose size exceeds approximately 200 μm (micro meters) are discharged by centrifugal force into the ash removal hopper by the flue gas flow, which reverses over an approximately semicircular path, whereas the finer ash particles collect in the outer peripheral portion of the reversing flue gas flow. As a result, high fly ash concentrations are formed in the flue gas, so that in the deflection, the zone of high flue gas speed substantially coincides with the zone of high ash concentration. Thus, if in the following upwardly directed flue there are incorporated convective heat exchangers such as boiler superheaters or evaporators as ancillary heating surfaces, the flue gases flow against them in a non-uniform manner, leading to high sooting rates in the area of maximum flue gas speed or fly ash concentration if the fly ash particles have softened by reaching the ash melting point. Admittedly, the sooting of the heating surfaces is smaller in the case of ash with a high melting point, i.e., not-softened fly ash particles, but such ash inturn often causes serious erosion damage to the superheater or evaporator.

Thus, in the case of conventional flue gas deflectors the centrifugal accelerations or forces do not suffice to separate small fly ash particles with a size below 200 μm from the flue gas flow or prevent ash particles with a diameter larger than about 100 μm from reaching the convective heat exchange surfaces arranged in the second flue, as would be desirable. The core of such large flue dust particles is often still soft or plastic, and they violently disintegrate on striking the heating surfaces, leading to the known sooting of the latter. If, however, these ash particles have completely solidified, or have not softened on striking the heat exchange surfaces, then due to their high kinetic energy they cause pronounced erosion which relatively rapidly destroys these heating surfaces in conjunction with corrosion. Furthermore, the one sided flow against the following vertical flue, i.e., the non-uniform action on the heat exchange surfaces incorporated therein, also has a disadvantageous action on the thermal loading of the heat exchanger tubes and the thermal efficiency of the boiler.

BRIEF SUMMARY OF THE INVENTION

According to the present invention a novel apparatus for improving the fly ash separation in combustion furnaces, particularly incinerators with a multipleflue boiler in which two vertical flues are interconnected by a lower deflector section includes a deflecting plate positioned in the deflector. The deflecting plate divides up the flue gas flow into two flow portions. A plate projection is provided on the side of the plate against which there is a flow and a wall projection is also arranged on the wall which bounds the back of the deflector.

BRIEF DESCRIPTION OF THE DRAWINGS

FIG. 1 is a side, sectional view of a fragment of two vertical flues of prior art incinerator with a conventional lower deflector.

FIG. 2 is graphical representation of the gas speed and ash concentration profile in the deflector of FIG. 1 in the plane A1–A2 of FIG. 1.

DESCRIPTION OF THE PRIOR ART APPARATUS

Figure 3:
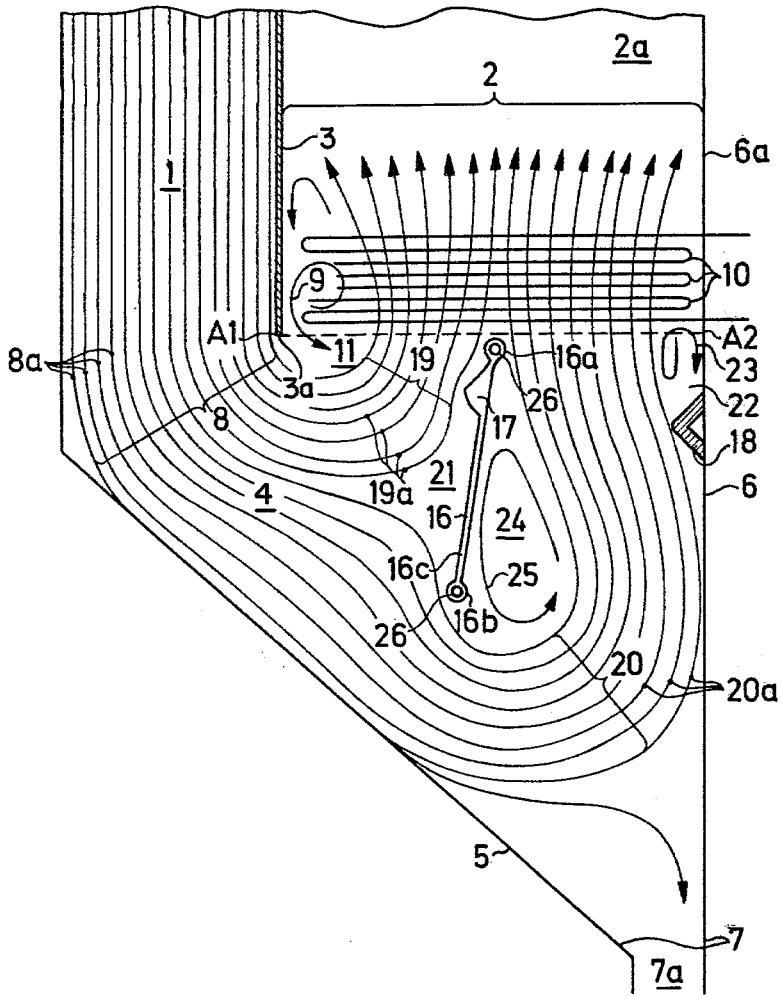
FIG. 3 is a side, sectional view of a fragment of two vertical flues of an incinerator in accordance with a preferred embodiment of the present invention.

FIG. 1 shows the two cross-sectionally rectangular vertical flues 1 and 2 of a prior art incinerator arrangement the flues 1, 2 are separated from one another by a vertical partition 3 and the lower ends are interconnected by a conventional 180° deflector 4 section. Deflector 4, together with an inclined front wall 5 and a vertical rear wall 6, forms a dust removal hopper 7 which is tapered on one side and through whose lower opening 7*a* the fly ash separated from the flue gas flow is removed. The flue gas flow, designated by the general reference numeral 8 and illustrated by its flow lines 8*a*, and which in the first downwardly directed flue 1 travels from top to bottom flows through the 180° deflector 4 with the maximum possible path radius, due to the centrifugal acceleration or centrifugal forces acting therein. It then enters the following, upwardly directed flue 2 in a direction from bottom to top. In the flow through the deflector 4, the flue gas 8 draws across the lower edge 3*a* of partition 3 and due to the centrifugal forces generates turbulence 9 in the area of the edge 3*a*. As a result, the flue gases only flow against the outside, i.e., on one side and at high speed against the second upwardly directed flue 2 in its inlet plane A1–A2. In addition, due to the centrifugal forces, the fly ash particles are displaced outwards on the approximately semicircular path of the flue gas flow 8, whereby the larger ash particles with a diameter exceeding approximately 200 μm are centrifugally discharged by flue gas flow 8 into the dust hopper 7, while the finer ash particles (approximately below 200 μm) collect in the outer part of the flue gas flow 8, which is changing its flow direction, and from the latter are carried upwards in deflector 4 and strike against the convective heat exchanger 10 arranged in the second flue 2. The heat exchanger 10 may be an evaporator or a superheater. In the inlet plane A1–A2 of the following flue 2, the ash concentration of the flue gases reached its maximum value at the extreme outside, i.e., close to the vertical hopper wall 6, which continues upwards as the rear boundary wall 6a of the second flue 2, while in the plane on the other side, i.e., on the inside in the area of the lower end of partition 3 with reference to flue gas flow 8, a dead zone 11 is obtained which is virtually controlled only by the above-mentioned flow separation turbulence 9 and is caused by the separation of flow 8 at edge 3a and the relatively large path radii of the individual flow lines 8a.

As the dead zone 11 is relatively large in the area of edge 3a or point A1, relative to the inlet cross-section A1–A2 of the second flue 2, there is a highly asymmetrical flow against the second flue 2, and consequently against heat exchange 10. In addition, the ash concentration increases greatly to the right towards point A2. This leads not only to a non-uniform thermal loading of heat exchanger 10, but also to a non-uniform sooting and mechanical stressing of it due to the one-sided impact of ash particles, i.e., increasing to the right towards point A2, as is qualitatively shown in the diagram of FIG. 2.

FIG. 2 shows the gas speed and ash concentration profile of the conventional deflector 4 of FIG. 1 in the horizontal inlet plane A1–A2 of the following flue 2, whereby line A1–A2 at the same time corresponds to the inside width of the gas inlet cross-section for the following vertical flue 2. The flue gas speed is plotted on the ordinate 12 to the left in the graph and the flue gas ash concentration in mg/Nm$^3$ (milligrams per cubicmeter to the at STP) right on the ordinate 13. On the abscissa are plotted the distances from point A1, i.e., from the lower edge 3a of vertical partition 3. In FIG. 2, the solid curve of the gas speed is designated by 14 and the broken curve of the ash concentration by 15. As has already been stressed these two curves represent the distribution over the line A1–A2 under consideration only qualitatively.

FIG. 2 firstly shows that both the gas speed 14 and the ash concentration 15 increase greatly towards point A2, i.e. relative to the reversing flue gas flow 8 outwardly towards wall 6 or 6a (cf FIG. 1). FIG. 2 also shows that to the left in the area of point A1, i.e., in the vicinity of wall edge 3a (cf FIG. 1) the gas speed 14 actually reverses and is negative, i.e., the flow is directed opposite to the desired main flow direction. This can be attributed to the turbulence 9 in separation zone 11 (cf FIG. 1). The gas speed 14 suddenly increases greatly towards and just before point A2, which is due to friction against the rear wall 6 of the hopper (cf FIG. 1).

DETAILED DESCRIPTION OF PREFERRED EMBODIMENT

FIG. 3 shows a novel apparatus according to the present invention for improving fly ash separation in the deflector. It is also shown in vertical section, with those elements which are similar to corresponding ones of the conventional prior art deflector of FIG. 1 being given the same reference numerals.

The novel apparatus comprises substantially a combination of three guide or deflecting members 16, 17, 18. A delecting plate 16 is incorporated into the lower 180° deflector 4 and divides up the incoming flue gas flow 8 into two partial flows 19 and 20; a plate projection 17 is provided on its outflow side 16c of the plate 16; and, a wall projection 18 is provided on the hopper wall 6, which is the rear boundary of the deflector 4.

The individual flow lines which illustrate the flow in deflector 4 are designated by 19a and 20a in FIG. 3 for the two flue gas flow portions 19, 20. The two flow portions 19, 20 generated by the deflecting plate 16 through dividing up the flue gas flow 8 passing out of the first downwardly directed vertical flue 1 within deflector 4 are deflected with a much smaller radius than the total flue gas flow 8 in the conventional deflector of FIG. 1, as will be described in greater detail hereinafter. Since the centrifugal acceleration is inversely proportional to the path radius of the flow, the centrifugal forces which displace the ash particles on the curved flow path outwards are much larger here than in the significantly larger path radius of the apparatus of FIG. 1. Thus, the separation of fly ash particles from the two flue gas flow portions 19, 20 is considerably increased.

The linearly constructed, i.e., provided with at least approximately parallel but planar main surfaces, deflecting plate 16 terminates at the rear, relative to the path of the two flow portions 19, 20, i.e., with its upper edge 16a just in front of the horizontal inlet plane A1–A2 of the following upwardly directed vertical flue 2. Deflecting plate 16, which in this case is inclined slightly relative to the hopper rear wall 6 in the flow direction of the two flow portions 19, 20, engages part of the flue gas flow 8 and guides it behind the edge 3a of partition 3, where flow separation again takes place, in the form of flow portion 19 into the following vertical flue 2. The flow portion 19 has a much smaller radius than the undivided flue gas flow 8 of FIG. 1, so that the separation turbulence 9 is also smaller than the corresponding turbulence 9 of FIG. 1. The relatively large fly ash particles carried along by flow portion 19 and whose size exceeds about 100 μm are discharged into a steady-flow zone 21 at the inflow side 16c of deflecting plate 16, due to the centrifugal forces in that flow portion. From zone 21, the particles trickle downwards along deflecting plate 16 to its lower edge 16b, where they are picked up by the outer flow portion 20 which flows round the bottom of deflecting plate 16.

Since the radius of the flue gas flow portion 20 is at least approximately as large as the radius of the inner or upper flue gas flow portion 19, the ash particles are separated a second time by the outer partial flow 20, due to the centrifugal forces therein, and are then discharged by centrifugal forces into ash hopper 7, together with the correspondingly large ash particles (i.e., whose size is also above about 100 μm) which were present from the outset in flow portion 20.

A plate projection 17 is provided on the side 16c of the deflecting plate 16 and forms the upper edge 16a thereof in accordance with FIG. 3. The projection is located at the rear with reference to the flue gas path, i.e., at the upper end of deflecting plate 16, and modifies the gas flow to produce the steady-flow zone 21 necessary for separating the fly ash from the inner or upper partial flow 19. At the same time, it displaces the partial flow 19 in the direction of dead zone 11, which is virtually only controlled by the separation turbulence 9, i.e., the main flow does not flow through it, so that this zone, which is in any case smaller than in FIG. 1 due to the much smaller deflection radius at the partition edge 3*a*, is still further constricted.

A second guide projection 18 is arranged horizontally across the inside of the rear hopper wall 6 and at approximately the same height as the lower portion of guide projection 17. It has a substantially constant angular cross-section. Due to the projection 18, which extends over the entire inside width of the cross-section of the second flue 2, the deflection radius of the outer partial flow 20 which flows round the bottom of deflecting plate 16 is reduced, which in turn contributes to the symmetrical flow against the heating surfaces of the convective exchanger 10. At its outflow, the projection 18 poduces a relatively limited third low pressure zone 22 in which a correspondingly small turbulence is formed. However, zone 22 has the effect of maintaining small a third low pressure zone 24 formed at the outflow side of deflecting plate 16, together with the turbulence 25 produced therein. By utilising the partial vacuum therein, it deflects the outer flow 20 toward deflecting plate 16 in such a way that the flow portion 20 combines at the upper end of deflecting plate 16 with the other, inner flow portion 19, leading to an almost vertical symmetrical flow against the heating surfaces of convective heat exchanger 10, i.e. a uniform flow over the inlet cross-section A1–A2 of the second flue 2.

The inter-action between deflecting plate 16, plate projection 17, and the wall projection member 18 as a function of the position and construction of the group of flow lines 19*a*, 20*a* of the two flow portions 19, 20 according to FIG. 3, leads to a much more favorable flow against the heat exchanger 10 fitted at the bottom of the following upwardly directed flue 2 than when using the conventional deflector 4 without such members or with the single group of flow lines 8*a* of the undivided flue gas flow 8 of FIG. 1. Compared with the conventional deflector 4 of FIG. 1, the system according to the invention prevents local excessive sooting and mechanical overstressing of the pipes of the convective heat exchanger 10 due to fly ash particles and thermal overloading of the pipes in virtually the same pipe areas.

Figure 4:
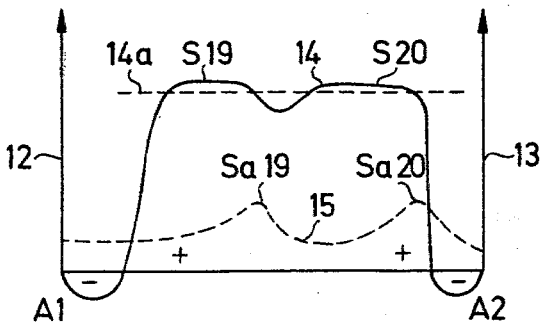
FIG. 4 is a graphical representation of the gas speed and ash concentration profile of the deflector of flues of FIG. 3 in the plane A1–A2 of FIG. 3.

FIG. 4 qualitatively shows the gas speed and ash concentration profile in inlet plane A1–A2 of the following upwardly directed flue 2 for the deflector 4 equipped with the apparatus 16, 17, 18 of FIG. 3. When comparing with the corresponding graph for the conventional deflector 4 of FIG. 2, it is firstly apparent that gas flow 14, which in the case of the conventional deflector is displaced to one side towards point A2, i.e., towards the rear hopper wall 6 or rear wall 6*a* of the second flue 2, is now distributed over a relatively large central area of line A1–A2. Admittedly, curve 14 has two peaks S19 and S20 associated with the two flow portions 19, 20 (cf FIG. 3), but their heights are relatively small compared with the average gas speed in this central area as indicated in FIG. 4 by the dotted horizontal line 14*a*, so that the gas speed 14 is virtually constant with the value 14*a* over this relatively broad central area. Admittedly, corresponding to the two separation turbulences 9 and 23 according to FIG. 3, the gas speed 14 twice changes to negative values, i.e., in the vicinity of the two points A1 and A2, but the resulting areas of negative gas speed are much smaller than the area at point A1 in the graph of FIG. 2 which result with the conventional deflection of FIG. 1 and which can be attributed to the much greater turbulence 9. The incident flow in the central area of inlet cross-section A1–A2 caused by apparatus 16, 17, 18 has the consequence that after relatively small penetration depths in the heat exchanger 10, the flue gases are distributed over the entire cross-section of the following vertical flue 2, unlike with the conventional flow (cf FIG. 1).

Compared with the corresponding curve 15 in FIG. 2 for the conventional deflector 4, the fly ash concentration 15 in the flue gases is much more uniformly distributed over the inlet cross-section A1–A2 of the following flue 2. Here again the two peaks Sa19 and Sa20 of curve 15, which are once again associated with the two flue gas flow portions 19, 20 (cf FIG. 3), in no way hide the fact that despite the maxima in the ash concentration curve 15 which form these two peaks Sa19 and Sa20, the fly ash concentration is much smaller and more balanced over the entire line A1–A2 than in the case of curve 15 of FIG. 2.

Certain constructional details of apparatus 16, 17, 18 of FIG. 3 are explained hereinafter. As can be gathered from FIG. 3, the flat deflecting plate 16, substantially constructed as a plane-parallel plate, extends perpendicularly to the two parallel side walls 2*a* of the following upwardly directed vertical flue 2, whereby it extends on either side up to side walls 2*a* and is fixed thereto. The upper horizontal deflecting plate edge 16*a*, which is also to the rear with respect to the path of the two partial flue gas flows 19 and 20, is located approximately in the center of lina A1–A2.

Figure 5:
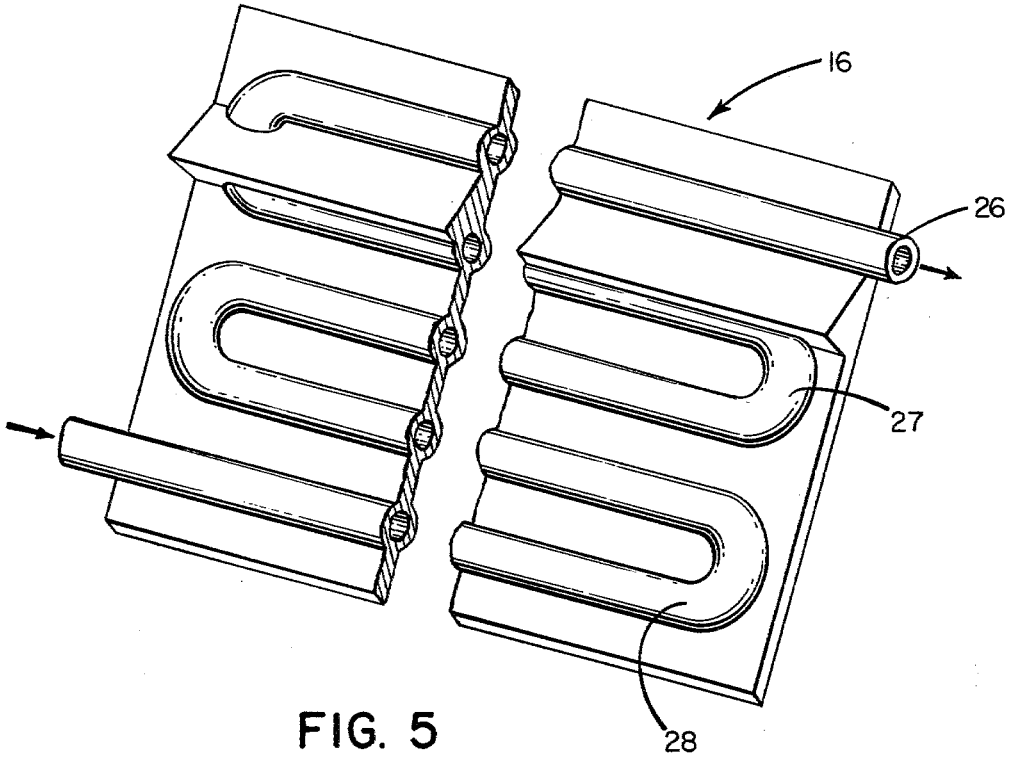
FIG. 5 is a cutaway perspective view of one embodiment of the deflecting plate shown in FIG. 3.
Figure 6:
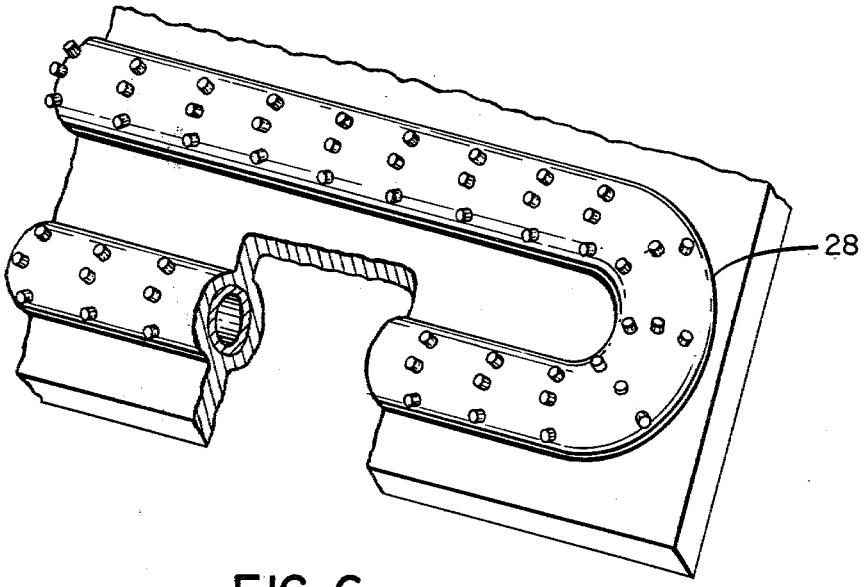
FIG. 6 is a cutaway perspective view of another embodiment of the deflecting plate shown in FIG. 3.
Figure 7:
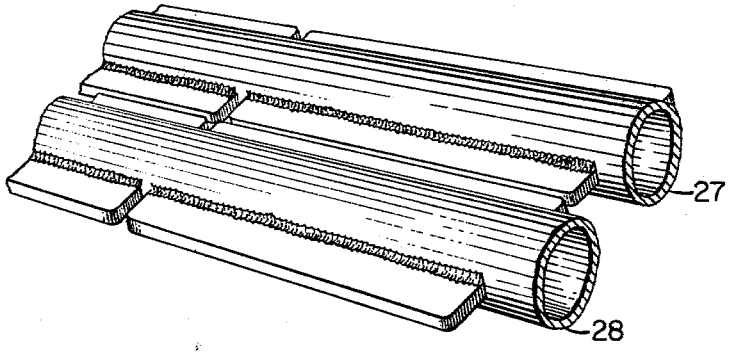
FIG. 7 is a partial perspective view of another embodiment of the deflecting plate shown in FIG. 3.
Figure 8:
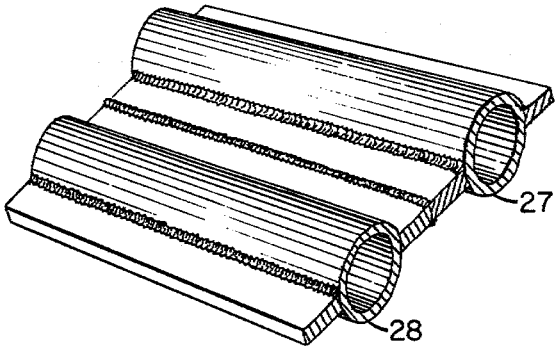
FIG. 8 is a partial perspective view of another embodiment of the deflecting plate shown in FIG. 3.
Figure 9:
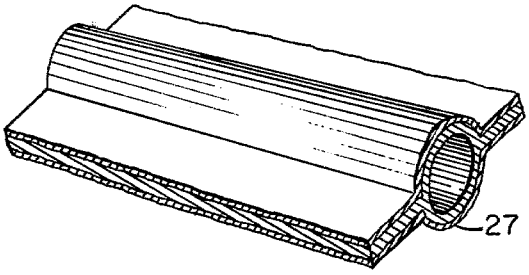
FIG. 9 is a partial perspective view of another embodiment of the deflecting plate shown in FIG. 3.

As indicated at points 26 in FIG. 3, deflecting plate 16 can at least partly comprise cooling pipes, which as evaporator pipes can be connected to the evaporator system of a boiler (See FIG. 5.) associated with the convective heat exchanger incorporated into the second upwardly directed vertical flue 2. However, as shown in FIG. 5, deflecting plate 16 could also completely comprise such cooling pipes, 26, 27 and 28, preferably having the first projection 17 fitted thereto, the cooling pipes 26, 27 and 28, extending in the longitudinal direction of plate 16 from bottom to top and are grouped at right angles to the flue side walls 2*a*. These cooling pipes 26, 27 and 28, are preferably studded and lined with ramming material, (See FIG. 6.) whereby they can be welded together as ridged pipes or constructed as finned pipes (See FIGS. 7 and 8.). However, deflecting plate 16 can also be uncooled and made from refractory steel or from refractory bricks. Deflecting plate 16 could also be separately cooled, i.e., constructed from pipes through which flows a flowable heat carrier medium. If the ancillary heating surfaces incorporated into the second upwardly directed flue 2 are periodically cleaned by a so-called "shower of spheres," as shown in FIG. 9, at least those portions of deflecting plate 16 exposed thereto, as well as plate projection 17 and the wall projection 18 can be armour-plated.

The advance in the art obtained with the apparatus according to the invention is in particular based on the fact that the incident flow of the following upwardly directed vertical flue or the convective heat exchanger located therein is much more balanced than with the flow obtained with conventional flue gas deflection, and consequently local excessive sooting and/or mechanical overstressing of the heat exchanger tubes by erosion and/or corrosion are avoided, leading to increased availability of the furnace. Furthermore, due to the more uniform incident flow of the second flue, the thermal stressing of the heat exchanger tubes is correspondingly more uniform.

In place of the deflecting 4 of FIG. 3, which has an ash removal hopper which is only tapered at the front, i.e., only at one side the above-described apparatus for improving the removal of fly ash, there could also be provided a deflector which is bounded on both sides, i.e., both to the front and rear by inclined hopper walls. In this case the position and configuration, particularly of the guide wall, must be adapted to the shape of the dust removal hopper, which is tapered on both sides. Instead of constructing the deflecting plate as a substantially plane-parallel plate, it could be at least partly curved, whereby circular, elliptical, parabolic or hyperbolic arcs could be used as the geometrical generatrix.

We claim:

1. An apparatus for separating fly ash particles from a flue gas flow in combustion furnaces with a multiple flue boiler, comprising:

a first vertical flue;

a second vertical flue;

a lower deflector section interconnecting said first and said second flues and adapted to conduct a flue gas flow from said first flue into said second flue;

a deflecting plate disposed in said deflector section having an incident surface in a confronting relationship with said flue gas flow, said deflecting plate being adapted to divide said flue gas flow into an inner first flow and an outer second flow to direct said inner first flow toward said second flue, and to produce radial centrifugal forces in said inner first flow sufficient to separate fly ash particles therefrom;

a first projection provided on said incident surface of said deflecting plate and adapted to modify passage of said inner first flow into said second flue;

a wall defining a boundary of said lower deflector section adjacent said second vertical flue and disposed in a spaced relationship to said deflecting plate and in a confronting relationship with said outer second flow, said wall being adapted to confine and direct said outer second flow toward said second flue and to produce radial centrifugal forces in said outer second flow sufficient to separate fly ash particles therefrom;

a second projection provided on said wall adapted to modify passage of said outer second flow into said second flue; and hopper means in communication with said lower deflector section for receiving from said lower deflector section fly ash particles deposited therein by said outer second flow and said inner first flow;

said first projection, said deflecting plate, said lower deflector boundary wall and said second projection being operable in combination to produce in said second flue a flow of flue gases having a substantially uniform cross-sectional velocity distribution and having a substantially uniform cross-sectional distribution of fly ash particles.

2. An apparatus according to claim 1, wherein said incident surface of said deflecting plate is formed at least partly by a planar surface.

3. An apparatus according to claim 1, wherein said deflecting plate is formed of two parallel planar surfaces.

4. An apparatus according to claim 1, wherein said deflecting plate is at least partly formed of cooling pipes adapted to be connected to an evaporator system of a steam or hot water boiler.

5. An apparatus according to claim 1, wherein said deflecting plate is substantially comprised of studded cooling pipes lined with ramming material, said cooling pipes being connected to an evaporator system of a steam or hot water boiler.

6. An apparatus according to claim 4, wherein said cooling pipes include exterior fins.

7. An apparatus according to claim 1, wherein said deflecting plate is not cooled and is formed of refractory steel.

8. An apparatus according to claim 1, wherein at least portions of said deflecting plate, said first projection, and said second projection exposed to a shower of spheres for cleaning ancillary heating surfaces arranged in said second flue are armor-plated.

9. An apparatus according to claim 1 further comprising:

a rear wall of said second flue extending from said lower deflector boundary wall in the direction of flow of said outer second flow;

a pair of spaced, opposed side walls of said second flue aligned substantially perpendicularly of said deflecting plate and intersecting said rear wall, said pair of side walls defining a transverse dimension of said second flue therebetween;

a partition disposed opposite of said rear wall and intersecting each of said pair of side walls to form a frontal boundary of said second flue separating said second flue from said first flue; and an edge of said deflecting plate extending in a direction substantially parallel to said transverse dimension and disposed downstream of said deflecting plate with respect to said direction of flow of said outer second flow, said edge being positioned substantially midway between said rear wall and said partition within said deflector section;

said deflecting plate extending from one of said pair of side walls to the other of said pair of side walls and being affixed thereto.

10. An apparatus according to claim 1 wherein said first projection forms an edge of said deflecting plate disposed downstream thereof with respect to the direction of flow of said outer second flow and wherein said first projection extends with a uniform cross-sectional dimension along the entire transverse length of said deflecting plate, said transverse length being substantially perpendicular to said direction of flow of said outer second flow portion and substantially parallel to said lower deflector boundary wall.

11. An apparatus according to claim 1 wherein said first projection projects from said incident surface of said deflecting plate and wherein said incident surface is planar on the portion thereof extending from said first projection to an edge of said deflecting plate disposed downstream thereof with respect to the direction of flow of said outer second flow.

12. An apparatus according to claim 1 wherein said second projection extends with a uniform cross-sectional dimension along the entire transverse length of said wall and wherein said second projection faces a surface of said deflecting plate opposite of and parallel to said incident surface, said transverse length being substantially perpendicular to the direction of flow of said outer second flow, and substantially parallel to said lower deflector boundary wall.

13. An apparatus according to claim 1 wherein said second projection and said first projection are disposed an equal distance below an opening of said second flue.

14. An apparatus according to claim 1 further comprising:

a partition separating said first flue from said second flue;

an inclined wall opposite of and spaced from said lower deflector boundary wall and angularly disposed with respect thereto, said inclined wall forming at least one part of said hopper means; and an edge formed on said deflecting plate upstream thereof with respect to the direction of flow of said outer second flow and spaced from said inclined wall;

said edge being adapted to divide said flue gas flow from said first flue into said inner first flow and said outer second flow so that said outer second flow passes between said edge and said inclined wall and is directed toward said lower deflector boundary wall.

15. An apparatus according to claim 1 wherein said deflecting plate is angularly disposed with respect to said lower deflector boundary wall, an edge of said deflecting plate disposed downstream thereof with respect to the direction of flow of said outer second flow being closer to said lower deflector boundary wall than an edge disposed upstream thereof with respect to said direction of flow of said outer second flow.

16. An apparatus according to claim 6 wherein said cooling pipes are welded together.

17. An apparatus according to claim 1 wherein said deflecting plate is not cooled and is formed of refractory brickwork.

18. An apparatus for separating fly ash particles from a flue gas flow in combustion furnaces with a multiple flue boiler, comprising:

a first vertical flue;

a second vertical flue;

a lower deflector section interconnecting said first and said second flues and adapted to conduct a flue gas flow from said first flue into said second flue;

a deflecting plate disposed in said deflector section and having an incident surface in a confronting relationship with said flue gas flow, said deflecting plate being adapted to divide said flue gas flow into an inner first flow and an outer second flow, to direct said inner first flow toward said second flue, and to produce radial centrifugal forces in said inner first flow sufficient to separate fly ash particles therefrom;

a first projection provided on said incident surface of said deflecting plate and adapted to modify passage of said inner first flow into said second flue;

a wall defining a boundary of said lower deflector section adjacent said second vertical flue and disposed in a spaced relationship to said deflecting plate and in a confronting relationship with said outer second flow, said wall being adapted to confine and direct said outer second flow toward said second flue and to produce radial centrifugal forces in said outer second flow sufficient to separate fly ash particles therefrom;

a second projection provided on said wall adapted to modify passage of said outer second flow into said second flue;

hopper means in communication with said lower deflector section for receiving from said lower deflection section fly ash particles deposited therein by said outer second flow and said inner first flow;

a rear wall of said second flue extending from said lower deflector boundary wall in the direction of flow of said outer second flow;

a pair of spaced, opposed side walls of said second flue aligned substantially perpendicularly of said deflecting plate and intersecting said rear wall, said pair of side walls defining a transverse dimension of said second flue therebetween;

a partition disposed opposite of said rear wall and intersecting each of said pair of side walls to form a frontal boundary of said second flue separating said second flue from said first flue; and an edge of said deflecting plate extending in a direction substantially parallel to said transverse dimension and disposed downstream of said deflecting plate with respect to said direction of flow of said outer second flow, said edge being positioned substantially midway between said rear wall and said partition within said deflector section;

said deflecting plate extending from one of said pair of side walls to the other of said pair of side walls and being affixed thereto.

19. An apparatus for separating fly ash particles from a flue gas flow in combustion furnaces with a multiple flue boiler; comprising:

a first vertical flue;

a second vertical flue;

a lower deflector section interconnecting said first and said second flues and adapted to conduct a flue gas flow from said first flue into said second flue;

a deflecting plate disposed in said deflector section and having an incident surface in a confronting relationship with said flue gas flow, said deflecting plate being adapted to divide said flue gas flow into an inner first flow and an outer second flow to direct said inner first flow toward said second flue, and to produce radial centrifugal forces in said inner first flow sufficient to separate fly ash particles therefrom;

a wall defining a boundary of said lower deflector section adjacent said second vertical flue and disposed in a spaced relationship to said deflecting plate and in a confronting relationship with said outer second flow, said wall being adapted to confine and direct said outer second flow toward said second flue and to produce radial centrifugal forces in said outer second flow sufficient to separate fly ash particles therefrom; and hopper means in communication with said lower deflector section for receiving from said lower deflection section fly ash particles deposited therein by said outer second flow and said inner first flow;

said deflecting plate being operable to produce in said second flue a flow of flue gases in which the uniformity of the cross-sectional velocity distribution and the uniformity of the cross-sectional distribution of fly ash particles are substantially improved.

* * * * *